US006290121B1

(12) United States Patent
Ogbue

(10) Patent No.: US 6,290,121 B1
(45) Date of Patent: Sep. 18, 2001

(54) PACKAGING TO HOLD FASTFOODS AND EXPOSE ONLY BITE-SIZED PORTIONS BEING EATEN

(76) Inventor: M. Udeozo Ogbue, 5159 Micmac Crescent, Mississauga, Ontario (CA), L5R 2C9

( * ) Notice: Subject to any disclaimer, the term of this patent is extended or adjusted under 35 U.S.C. 154(b) by 0 days.

(21) Appl. No.: 09/420,927

(22) Filed: Oct. 19, 1999

(51) Int. Cl.[7] ..... B65D 65/26

(52) U.S. Cl. ..... 229/87.05; 229/87.08; 229/938

(58) Field of Search ..... 426/123, 122; 229/87.05, 101.1, 938, 87.08; 383/2

(56) References Cited

U.S. PATENT DOCUMENTS

| | | | | |
|---|---|---|---|---|
| 2,210,302 | * | 8/1940 | Petter | 229/938 X |
| 4,760,950 | * | 8/1988 | Levick | 383/2 X |
| 4,777,054 | * | 10/1988 | Greenhouse | 229/938 X |
| 5,042,666 | * | 8/1991 | Dolene | 229/938 X |
| 5,110,038 | * | 5/1992 | Pantisano et al. | 426/115 X |
| 5,421,508 | * | 6/1995 | Beales | 229/938 X |
| 5,626,250 | * | 5/1997 | Dorazio | 229/101.1 X |

FOREIGN PATENT DOCUMENTS

| | | | | |
|---|---|---|---|---|
| 2 665 882 | * | 2/1992 | (FR) | 229/101.1 |
| 2 677 621 | * | 12/1992 | (FR) | 229/87.05 |
| 12997 | * | of 1911 | (GB) | 229/87.05 |

* cited by examiner

*Primary Examiner*—Jes F. Pascua

(57) ABSTRACT

A more convenient, user-friendly and less messy packaging that enables the eater to cleanly and hygienically hold and handle hamburgers, beef burgers, cheeseburgers, chicken burgers, fish burgers, croissant sandwiches, Kaiser sandwiches and similar fast foods; and expose one bite-sized portion of the fast food at a time. The packaging shell has symmetrical and matching segments in the bottom and top plates that the eater can tear off in order to expose the fast food in one bite-sized portion at a time while eating; and, provides space to act as a trough for catching morsels, spills, drips, and run-offs and fluids from vegetables and condiments.

5 Claims, 1 Drawing Sheet

PACKAGING TO HOLD FASTFOODS AND EXPOSE ONLY BITE-SIZED PORTIONS BEING EATEN

SPECIFICATIONS

This invention relates to packaging, serving, holding, handling and consumption of convenience and fast foods such as hamburgers, beef burgers, cheeseburgers, chicken burgers, fish burgers, croissant sandwiches, Kaiser sandwiches and similar fast foods. It specifically concerns a holding, handling, preserving and dispensing shell to enable customers to eat servings of burger-type fast foods while minimising the risk of soiling and contaminating same with dirty hands; ingesting the hand-contaminated food; having too much of the food go cold; and, spilling and splattering of morsels, condiments, remnants and fluids on clothing, furniture and vehicle interiors. Fast and convenience food outlets have become popular features around the world Cities, towns, communities and highways in North America and all over the world boast such fast food outlets as "McDonald's", "Wendy's", "Burger King", "Harvey's", "A&W", "Subway", "Arby's", "Lick's" and others depending on the continent and particular country. Convenience and fast food outlets present their burgers, bun sandwiches and similar fast foods to customers in unit packaging such as paper wraps, plastic wraps, paper boxes, cardboard boxes or styrofoam boxes.

The customers proceed to eat the burgers by first unwrapping the paper fully or partially with a risk of mess, or opening the box and grasping and lifting the fast food (again with a risk of mess). Eating of the unwrapped and exposed burger or bun sandwich is done with condiments and fluids spilling and dripping from all sides in the fast food premises, motor vehicle or home. Most customers who have little time or opportunity to wash their hands are compelled to handle and contaminate their fast foods due to the use of the current inconvenient, untidy and unhygienic, full-exposure packaging. A lot of care is exercised by the customers to avoid soiling the fast food with usually dirty hands; letting the food go cold; squeezing out the condiments, fluids and morsels; and soiling their clothing, furniture and vehicle interiors. A major drawback of the current packaging for burger and bun sandwich fast foods is the inconvenient and unhygienic aspects of forcing workers straight out of construction sites, plants, factories, warehouses and similar workplaces; and travellers coming off the roads and highways; to handle and eat their fast foods with dirty hands and risk food contanination, food spill and mess.

The listed disadvantages of current packaging may be overcome by my new invention (called Clean Bite Pack, Easy Bite Pack or Neat Pack). An object of my new invention is to provide a user-friendly packaging shell that is segmented in order to be dismantled in stages to enable the eater of burger-type fast foods to enjoy the foods conveniently, neatly and hygienically by:

holding and handling only the packaging shell, and not the fast food, with bare and often dirty hands;

easily tearing off segments of the packaging shell which correspond to bite-sized portions of the fast food being eaten;

exposing only one bite-sized portion of the fast food at a time to be bitten off and eaten, not the entire serving;

keeping the remaining fast food intact and warm inside the partial shell of the packaging; and, trapping and confining the squeezed out condiments, morsels, remnants and fluids in the trough of the packaging.

This invention will enable eaters/consumers of burger-type and bun-sandwich fast and convenience foods to enjoy their foods inside or outside the fast and convenience food premises without concerns for:

touching their fast foods with often dirty hands;

soiling and contaminating their fast foods with dirty hands;

ingesting the hand-contaminated fast foods;

having their fast foods go cold from overexposure while being eaten; and soiling their hands, clothing, furniture and vehicle interiors with morsels, condiments remnants and fluids.

FULL DESCRIPTION

The form of the list and the description is illustrated by the following (Please see FIGS. 1, 2 and 3):

In drawings which illustrate embodiments of the invention,

Figure 3:
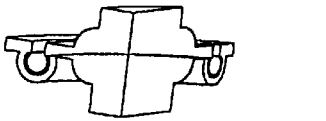
FIG. 3 is the detail of the jointing to assemble and secure the top plate of the packaging shell to the bottom plate.
Figure 4:
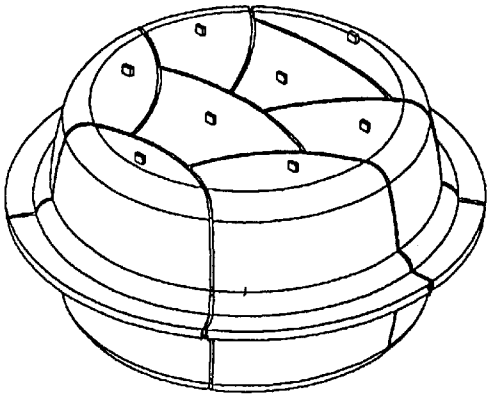
Figure 1:
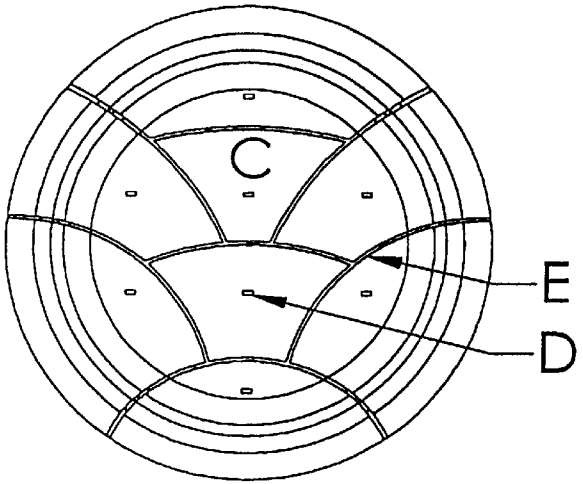
FIG. 1 illustrates the plan view of the bottom plate and top plate of the packaging assembled, with the symmetrical, bite-sized, break-off segments and their borders shown.
Figure 2:
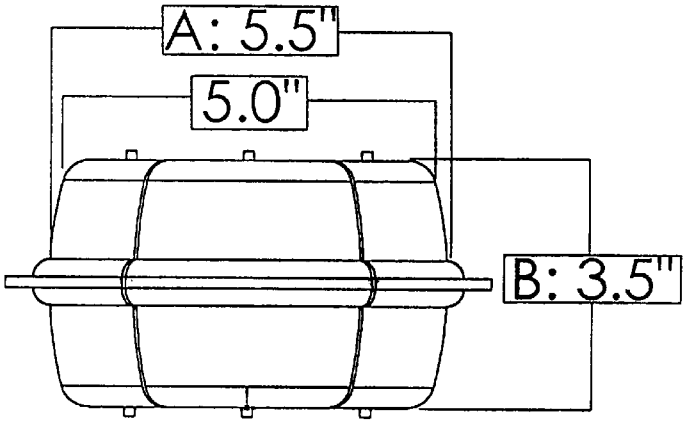
FIG. 2 is a side view of the packaging shell.

The new packaging illustrated comprises a bottom plate and a top plate with inside well diameter (or length/width) of a burger/sandwich bun (114 mm to 165 mm, or 4.5 inches to 6.5 inches in this example), plus 25.4 mm, or 1-inch clearance, for a total of 190.4 mm, or 7.5 inches. Depending on the number of layers to be built in the burger/sandwich offering, each plate has a depth of 38 mm to 76 mm, or 1½ inches to 3 inches such that when the bottom and top plates are assembled, the total inside height is approximately 76 mm to 153 mm, or 3 inches to 6 inches. This is to accommodate the average height of a single, double or triple-decker burger/sandwich plus a 12.7 mm or ½ inch height clearance. The bottom plate of the packaging shell has a foldable flange extending 12.7 mm or ½ inch beyond the stiff flange of the top plate. Both the bottom plate and the top plate are formed with segments roughly equal to bite-sized portions of the burger or sandwich to be contained in the packaging. The geometric patterns of the bite-sized segments are symmetrical and identical on the bottom and top plates. Matching of the corresponding bite-sized segments on the bottom and top plates is accomplished with one-way lining bumps on the flange of each plate.

While the thickness of the plate material is about 3 mm or 0.12 inch, the borders between individual bite-sized segments on each plate are thinned to about 1.5 mm or 0.06 inches and made partially brittle. This design feature is to facilitate easy tearing and peeling off of the matching bite-sized segments in the bottom and top plates (with no debris) to expose the bite-sized portions of the burger/sandwich being eaten. A protruding rib, 8 mm long×8 mm high, or 5/16 inch×5/16 inch is also formed in the middle of each tear-off segment to enhance initial grip of the segment before tear off (with dirty hands!). Each Clean Bite Pack, Easy Bite Pack or Neat Pack packaging can hold a single, double or triple-decker hamburger, beef burger, cheeseburger, fish burger, chicken burger, croissant sandwich, Kaiser sandwich or similar bun-sandwiched fast food with at least 12.7 mm or ½ inch clearance around the circumference and up to 6.0 mm or ¼ inch clearance at top and bottom of the fast food assembly inside.

In order to serve a burger-type fast food in the new packaging, the server:

places the bottom plate face up on a counter or flat surface;

puts the assembled hamburger, beef burger, cheeseburger, fish burger, chicken burger, croissant sandwich, Kaiser sandwich or similar fast food into the bottom plate;

places the top plate face down on the bottom plate such that the flanges of the two plates mate, with the bottom plate flange extending beyond the top plate flange 12.7 mm or ½ inch all around, and locks the lining bumps;

folds the longer, flexible flange of the bottom plate over the shorter, stiff flange of the top plate around the circumference to secure the contents of the packaging; and, serves the ideally packaged burger/sandwich to the customer.

In order to conveniently, neatly and hygienically eat a burger-type fast food from the new packaging, the customer/eater:

picks up the new packaging containing the burger/sandwich;

unfolds and tears the edges of one bite-sized segment of the packaging;

grips, bends, tears off and discards the matching bite-sized segment from both the top plate and bottom plate of the packaging;

bites off and chews/eats one exposed bite-sized portion of the burger/sandwich;

grips, bends, tears off and discards other matching bite-sized segments from both the top plate and bottom plate of the packaging; and, bites off and eats the exposed bite-sized portions of the burger/sandwich one at a time to her/his satisfaction.

The embodiments of the invention in which an exclusive property or privilege is claimed are as follows:

1. A single layer packaging for handling a sandwich contained therein comprising a bottom plate having a flexible flange, a top plate having a rigid flange that is shorter than the flexible flange of the bottom plate, the bottom plate being locked to the top plate by lining bumps and by folding the flexible flange of the bottom plate over the stiff flange of the top plate, the bottom and top plates being further divided into symmetrical and corresponding segments that are defined by thinned and partially brittle borders wherein the segments are detachable along the borders, and the middle of each segment includes a protruding rib.

2. The single layer sandwich packaging of claim 1 wherein the top and bottom plates are made of plastic.

3. The single layer sandwich packaging of claim 1 wherein the top and bottom plates are made of paper.

4. The single layer sandwich packaging of claim 1 wherein the top and bottom plates are made of metal foil.

5. The single layer sandwich packaging of claim 1 wherein the top and bottom plates are made of expanded synthetic resinous material.

* * * * *